US006888503B2

(12) United States Patent
Shikata

(10) Patent No.: US 6,888,503 B2
(45) Date of Patent: May 3, 2005

(54) ANTENNA UNIT STABLE IN ANTENNA CHARACTERISTICS AND ACHIEVABLE IN LENGTHENING OF LIFE

(75) Inventor: Masaru Shikata, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 19 days.

(21) Appl. No.: 10/642,806

(22) Filed: Aug. 15, 2003

(65) Prior Publication Data

US 2004/0070539 A1 Apr. 15, 2004

(30) Foreign Application Priority Data

Aug. 27, 2002 (JP) ..... 2002-247047

(51) Int. Cl.[7] ..... H01Q 1/26; H01Q 1/42
(52) U.S. Cl. ..... 343/700 MS; 343/872
(58) Field of Search ..... 343/711–715, 700 MS, 343/841, 872, 892, 911 R, 718

(56) References Cited

U.S. PATENT DOCUMENTS 5,585,806 A * 12/1996 Ogino et al. ..... 343/700 MS
5,940,037 A * 8/1999 Kellerman et al. .. 343/700 MS
6,278,369 B2 * 8/2001 Smith et al. ..... 340/572.7
6,366,245 B1 * 4/2002 Schmidt et al. ..... 343/700 MS
2002/0047807 A1 * 4/2002 Talvitie et al. ..... 343/702

FOREIGN PATENT DOCUMENTS

| | | |
|---|---|---|
| EP | 0 851 531 | 7/1998 |
| JP | H06-152237 | 5/1994 |
| JP | H09-223912 | 8/1997 |
| JP | 09223912 | 8/1997 |

* cited by examiner

*Primary Examiner*—Don Wong
*Assistant Examiner*—Minh Dieu A
(74) *Attorney, Agent, or Firm*—Brinks Hofer Gilson & Lione

(57) ABSTRACT

At least a part of mount pieces of a shield casing is arranged in locations adjacent to sides of a dielectric board to positionally restrain an antenna element. Even when torque with a feeding pin as an axis of rotation acts on the antenna element, the antenna element does not move in a direction of rotation.

3 Claims, 3 Drawing Sheets

ANTENNA UNIT STABLE IN ANTENNA CHARACTERISTICS AND ACHIEVABLE IN LENGTHENING OF LIFE

BACKGROUND OF THE INVENTION

1. Field of the Invention

The present invention relates to a small-sized antenna unit mounted on a moving body, for example, vehicles or the like and suitable as antenna units for ITS (Intelligent Transport System) such as ETC (Estimated Time of Completion), VICS (Vehicle Information Communications System), or the like, or antenna units for GPS (Global Positioning System).

2. Description of the Related Art

The prior art of such kind of antenna unit is described in Japanese Unexamined Published Patent Application No. H9-223912 and so on. Such prior art will be described with reference to a cross sectional view of FIG. 5. An antenna unit shown in the figure is mainly composed of a circuit board 1 provided on a bottom surface thereof with an amplifier 2, an antenna element 3 mounted on the circuit board 1, and a shield casing 4 of metallic sheet mounted on the circuit board 1 to shield the amplifier 2.

A ground conductor 5 is provided on a substantially whole roof surface of the circuit board 1 to be used as a ground for the antenna element 3. The antenna element 3 is called a patch antenna to comprise a patch electrode 7 having a predetermined shape (for example, substantially square) and provided on a roof surface of a dielectric board 6, which is square as viewed in plan view. An upper end of a feeding pin 8 extending through the dielectric board 6 is soldered to a feeding point of the patch electrode 7. Since a lower end of the feeding pin 8 is soldered to the amplifier 2, the patch electrode 7 and the amplifier 2 are electrically connected to each other. A ground electrode 9 is provided on a substantially whole bottom surface of the dielectric board 6, and the antenna element 3 is placed on the circuit board 1 in a state, in which the ground electrode 9 is brought into close contact with the ground conductor 5. The shield casing 4 is formed to have a box-shape with a top opening, and mount pieces 4*a* provided projectingly in a plurality of locations on a peripheral edge of the opening are inserted through the circuit board 1 to be bent whereby the shield casing 4 is mounted on the circuit board 1 in a state, in which it covers the amplifier 2.

With the antenna unit schematically constructed in this manner, a feeding cable such as coaxial cable or the like is connected to the amplifier 2, so that when a predetermined high frequency signal is fed to the patch electrode 7 via the amplifier 2, circular polarization or linear polarization is emitted from the patch electrode 7. Also, a signal received by the patch electrode 7 is output to a receiver circuit via the amplifier 2 and the feeding cable. In addition, in the case where the shield casing 4 covers the amplifier 2 as in the antenna unit, high reliability can be ensured since there is sharply reduced the possibility that antenna characteristics is deteriorated by undesirable radio waves radiated from the amplifier 2 and interfering waves from outside adversely affect the amplifier 2.

With the antenna unit of the prior art shown in FIG. 5, while the antenna element 3 is fixed to the circuit board 1 by soldering both ends of the feeding pin 8 to the patch electrode 7 and the amplifier 2, torque with the feeding pin 8 as an axis of rotation acts on the antenna element 3, which is fixed only at the feeding point, so that vibrations during traveling make the antenna element 3 liable to fluctuate on the circuit board 1 in a direction of rotation, such fluctuation giving rise to a cause for making antenna characteristics unstable. Also, when the antenna element 3 fluctuates in the direction of rotation, stress such as torsion or the like acts on the feeding pin 8 and its soldered portions to cause a problem that a danger of failure in conduction is increased in likelihood and lengthening of life is hard to achieve.

SUMMARY OF THE INVENTION

The invention has been though of in view of such situation in the prior art, and has its object to provide an antenna unit, which is stable in antenna characteristics and can achieve lengthening of life.

To attain the above object, the invention provides an antenna unit including an antenna element comprising a patch electrode provided on a roof surface of a dielectric board, a circuit board provided on a bottom surface thereof with an amplifier and mounting the antenna element on a roof surface thereof, a shield casing mounted on the circuit board to cover the amplifier, and a feeding pin having one end thereof connected to the patch electrode and the other end thereof connected to the amplifier, and wherein projecting pieces are provided on the shield casing to extend through the circuit board to be arranged in positions adjacent to sides of the dielectric board and the antenna element is positionally restrained relative to the dielectric board by the projecting pieces.

When the projecting pieces of the shield casing are thus made adjacent to the sides of the dielectric board to positionally restrain the antenna element, even application of vibrations or the like causes no fear that the antenna element on the circuit board fluctuates in a direction of rotation, thus achieving stability in antenna characteristics and greatly reducing stress such as torsion or the like acting on the feeding pin and its soldered portions, so that lengthening of life is expectable. Also, since the number of parts is not increased, it is easy to avoid an increase in cost.

With such constitution, when a plurality of mount pieces are provided on the shield casing to be mounted on the circuit board and at least a part of the mount pieces serves as the projecting pieces, the mount work of the shield casing and the work of positioning the projecting pieces in a predetermined position can be done at the same time, which is preferable since the assembling quality can be prevented from being deteriorated by the projecting pieces.

Also, in the case where solder lands are provided on the sides of the dielectric board on the antenna element, and the solder lands are soldered to the projecting pieces, the antenna element is strongly fixed to the circuit board, whereby stability in antenna characteristics and lengthening of life can be further promoted.

DESCRIPTION OF THE PREFERRED EMBODIMENTS

Figure 1:
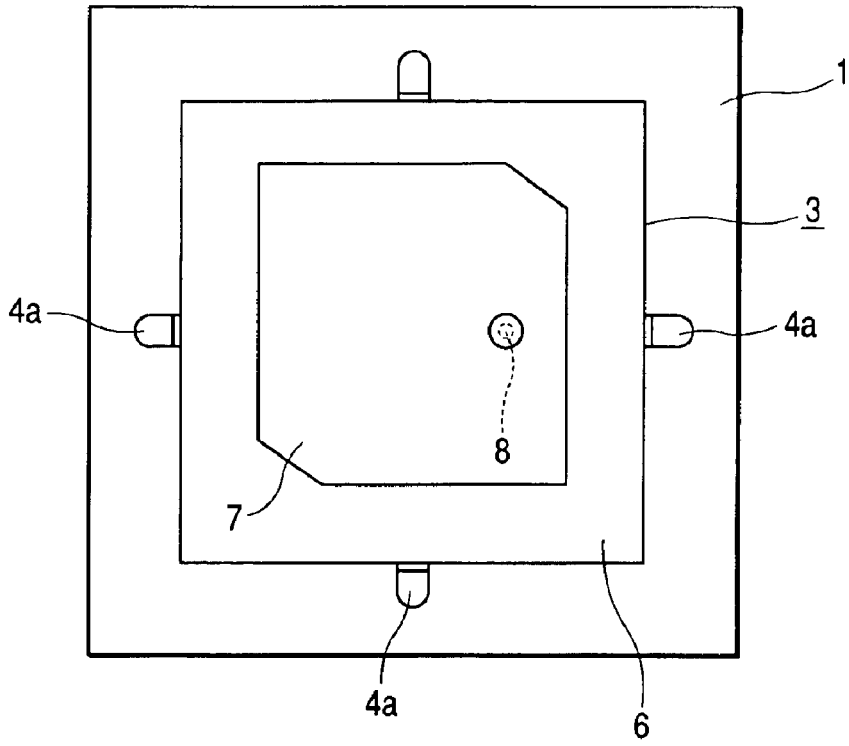
FIG. 1 is a plan view showing an antenna unit according to an embodiment of the invention.
Figure 2:
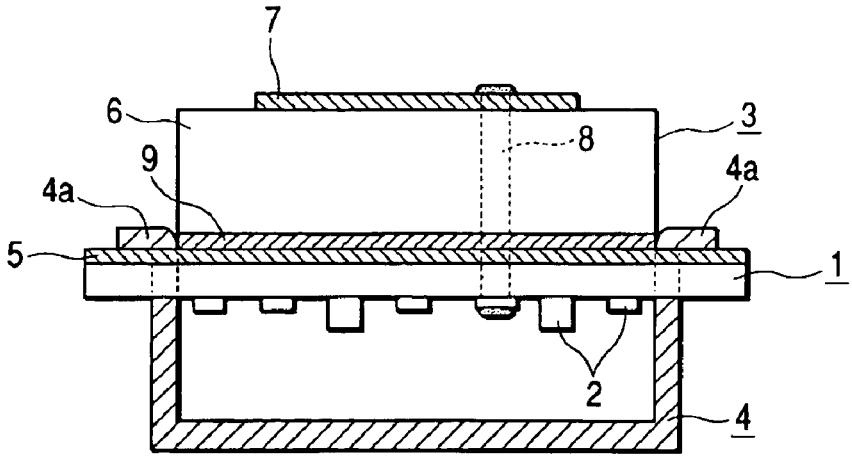
FIG. 2 is a cross sectional view showing the antenna unit.
Figure 3:
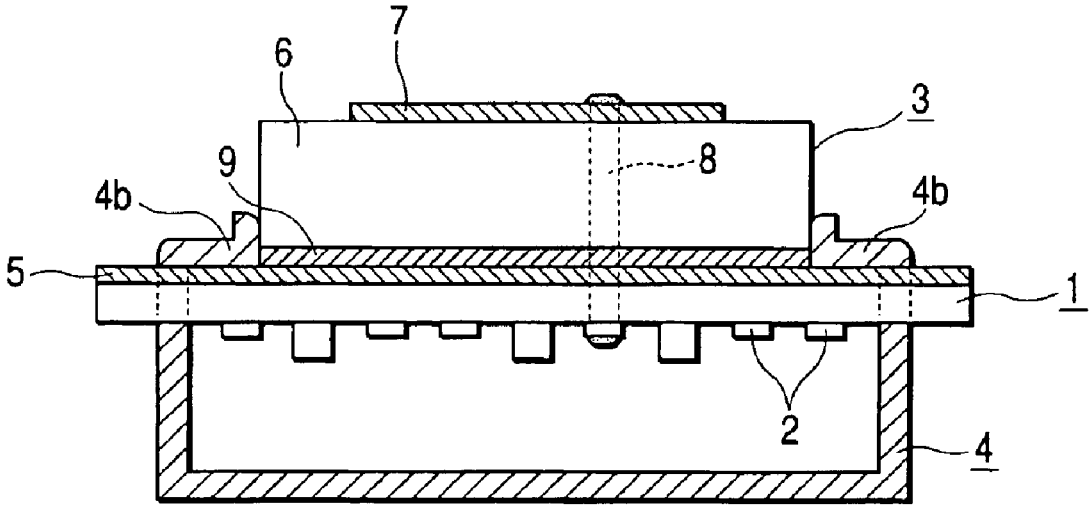
FIG. 3 is a cross sectional view showing an antenna unit according to a further embodiment of the invention.
Figure 4:
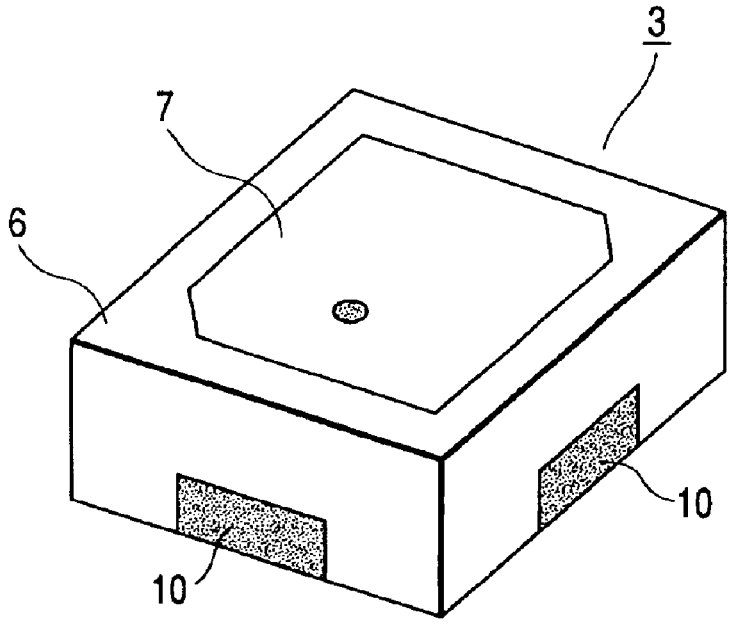
FIG. 4 is a perspective view showing an antenna unit according to a still further embodiment of the invention.
Figure 5:
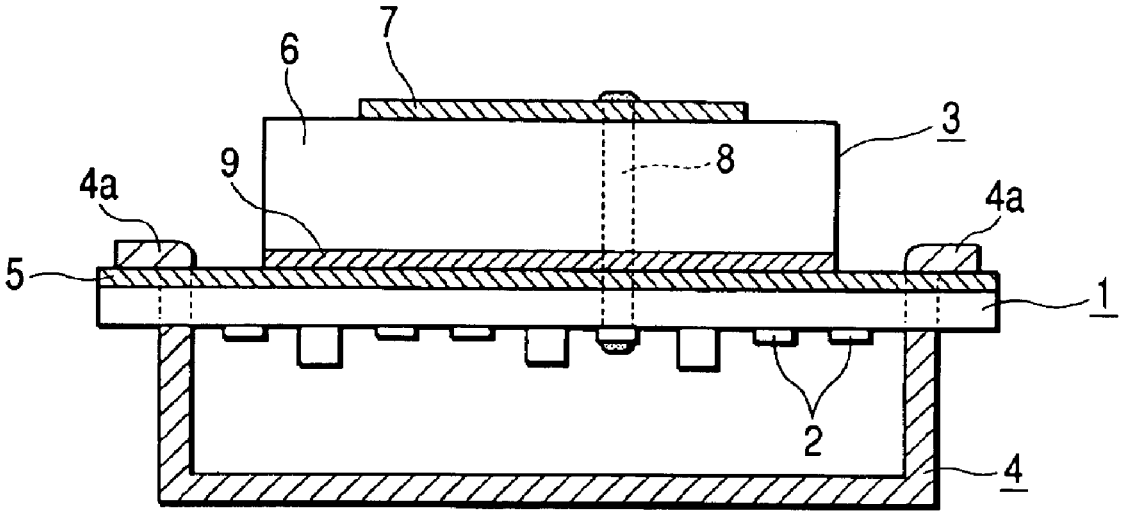
FIG. 5 PRIOR ART
FIG. 5 is a cross sectional view showing an antenna unit according to the prior art.

An explanation will be given to embodiments of the invention with reference to the drawings. FIG. 1 is a plan view showing an antenna unit according to an embodiment of the invention, FIG. 2 is a cross sectional view showing the antenna unit, FIG. 3 is a cross sectional view showing an antenna unit according to a further embodiment of the invention, and FIG. 4 is a perspective view showing an antenna unit according to a still further embodiment of the invention. In addition, those parts in these drawings, which correspond to those in FIG. 5, are denoted by the same reference numerals as those in FIG. 5, and duplication of an explanation is suitably omitted.

An antenna unit shown in FIGS. 1 and 2 is greatly different from the prior art (see FIG. 5) in that an antenna element (patch antenna) 3 is positionally restrained by mount pieces 4*a* of a shield casing 4. That is, like the prior art, the antenna unit is mainly composed of a circuit board 1 provided at a bottom surface thereof with an amplifier 2, an antenna element 3 mounted on the circuit board 1, and the shield casing 4 of metallic sheet mounted on the circuit board 1 to shield the amplifier 2. With the embodiment, the four mount pieces 4*a* mounting the shield casing 4 on the circuit board 1 are arranged in locations adjacent to sides of an dielectric board 6 to positionally restrain the antenna element 3. Concretely, the mount pieces 4*a* provided projectingly in four locations on a peripheral edge of an upper opening of the shield casing 4 are inserted through the circuit board 1 in locations adjacent to sides of the dielectric board 6 to be bent outward, whereby the shield casing 4 is mounted on the circuit board 1 and the respective sides of the dielectric board 6 are positionally restrained by bent portions of the respective mount pieces 4*a*.

In addition, the remaining constitution of the embodiment is substantially the same as that of the prior art, such that a ground conductor 5 is provided on a substantially whole roof surface of the circuit board 1 and both upper and lower ends of a feeding pin 8 extending through the dielectric board 6 are soldered to the patch electrode 7 and the amplifier 2, respectively. Also, a ground electrode 9 is provided on a substantially whole bottom surface of the dielectric board 6 and the shield casing 4 mounted to the circuit board 1 by the respective mount pieces 4*a* covers the amplifier 2.

In this manner, with the antenna unit according to the embodiment, the mount pieces 4*a* of the shield casing 4 positionally restrains the antenna element 3, so that even when vibrations apply, there is no fear that the antenna element 3 on the circuit board 1 fluctuates in a direction of rotation, thus achieving stability in antenna characteristics. Also, since the rotating motion of the antenna element 3 is prevented, stress such as torsion or the like acting on the feeding pin 8 and its soldered portions is greatly decreased and so lengthening of life is expectable. Also, when the mount pieces 4*a* of the shield casing 4 are made use of as projections for restraining the rotating motion of the antenna element 3 as in the embodiment, any increase in the number of parts is not caused, and the mount work of the shield casing 4 and the positioning work of the antenna element 3 can be done at the same time, so that there is produced an advantage of avoiding an increase in cost.

In a further embodiment shown in FIG. 3, a shield casing 4 is large-sized as compared with an antenna element 3, and two among four mount pieces on the shield casing 4 make two lengthy projecting pieces 4*b*, which are bent inward and tip ends of which positionally restrain the antenna element 3. However, separate projecting pieces 4*b* other than the mount pieces may be provided on the shield casing 4.

Also, in a still further embodiment shown in FIG. 4, solder lands 10 are provided on sides of a dielectric board 6 of an antenna element 3, and the solder lands 10 can be soldered to mount pieces (projecting pieces) on a shield casing 4. When the solder lands 10 of the antenna element 3 are thus soldered to portions of the shield casing 4, the antenna element 3 can be surely fixed on a circuit board 1, whereby stability in antenna characteristics and lengthening of life can be further promoted.

The invention is put into practice in the embodiment described above to produce the effects described below.

Since the antenna unit is configured such that the projecting pieces of the shield casing adjoin sides of the dielectric board to positionally restrain the antenna element, even when vibrations are applied the antenna element on the circuit board will not move in a direction of rotation, thus achieving stability in antenna characteristics and improving reliability. Additionally since stress such as torsion or the like acting on the feeding pin and its soldered portions is greatly decreased, the device lifetime is increased.

What is claimed is:

1. An antenna unit including an antenna element comprising a patch electrode provided on a roof surface of a dielectric board, a circuit board provided on a bottom surface thereof, the circuit board having an amplifier, the antenna element mounted on a roof surface of the circuit board, a shield casing mounted on the circuit board to cover the amplifier, and a feeding pin having one end thereof connected to the patch electrode and an opposing end thereof connected to the amplifier, and projecting pieces provided on the shield casing that extend through the circuit board and are arranged in positions adjacent to sides of the dielectric board, the antenna element positionally restrained relative to the circuit board by the projecting pieces.

2. The antenna unit according to claim 1, further comprising a plurality of mount pieces provided on the shield casing to be mounted on the circuit board, and wherein at least a part of the mount pieces serves as the projecting pieces.

3. The antenna unit according to claim 1, further comprising solder lands provided on the sides of the dielectric board, the solder lands being soldered to the projecting pieces.

* * * * *